US008826777B1

(12) United States Patent
Shieh

(10) Patent No.: US 8,826,777 B1
(45) Date of Patent: Sep. 9, 2014

(54) FASTENING TOOLS FOR CONNECTORS AND METHODS OF FASTENING CONNECTORS

(75) Inventor: Roung-Min David Shieh, Huntington Beach, CA (US)

(73) Assignee: The Boeing Company, Chicago, IL (US)

( * ) Notice: Subject to any disclaimer, the term of this patent is extended or adjusted under 35 U.S.C. 154(b) by 234 days.

(21) Appl. No.: 13/438,776

(22) Filed: Apr. 3, 2012

(51) Int. Cl.
*B25B 17/00* (2006.01)
*B25B 15/02* (2006.01)
*B25B 23/00* (2006.01)

(52) U.S. Cl.
CPC ..... *B25B 17/00* (2013.01)
USPC ..... 81/57.22

(58) Field of Classification Search
USPC ..... 81/57.22, 57.32, 57.36; 29/739, 741, 29/758, 759; 269/1, 100; 439/374, 378
See application file for complete search history.

(56) References Cited

U.S. PATENT DOCUMENTS 1,901,436 A * 3/1933 Coates ..... 81/57.22
2,069,882 A * 2/1937 Hall ..... 81/467
5,098,312 A * 3/1992 Raczynski ..... 439/362
5,169,334 A * 12/1992 Makita ..... 439/362
5,218,758 A * 6/1993 Nguyen ..... 29/837
5,444,906 A * 8/1995 Korsunsky et al. ..... 29/741
6,189,418 B1 * 2/2001 Sloan et al. ..... 81/57.36
6,679,721 B2 * 1/2004 Kim ..... 439/362
7,201,607 B2 * 4/2007 Bernhart et al. ..... 439/532
7,257,886 B2 * 8/2007 Haager et al. ..... 29/739
7,377,028 B2 * 5/2008 Hasircoglu et al. ..... 29/741
7,637,182 B1 * 12/2009 Long ..... 81/57.22
7,836,796 B2 * 11/2010 Chang ..... 81/57.22
7,971,509 B2 * 7/2011 Shortridge ..... 81/57.22
8,141,236 B2 * 3/2012 Fawzi et al. ..... 29/709
8,381,619 B2 * 2/2013 Hung ..... 81/57.22
2013/0047790 A1 * 2/2013 Shah et al. ..... 81/57.22

* cited by examiner

*Primary Examiner* — David B Thomas

(74) *Attorney, Agent, or Firm* — Hanley, Flight & Zimmerman, LLC

(57) ABSTRACT

Fastening tools for connectors and methods for fastening connectors are disclosed. An example apparatus includes an input shaft coupled to a gear train, a first output shaft coupled to the gear train and including a first screwdriver head, and a second output shaft coupled to the gear train and including a second screwdriver head. The gear train is to rotate the first and second output shafts simultaneously in response to a rotation of the input shaft.

20 Claims, 15 Drawing Sheets

FASTENING TOOLS FOR CONNECTORS AND METHODS OF FASTENING CONNECTORS

GOVERNMENT LICENSE RIGHTS

This invention was made with Government support under Contract No. 7000061309 CLIN 7814 (F4261) awarded by the United States Department of Defense. The Government of the United States has certain rights in this invention.

FIELD OF THE DISCLOSURE

This disclosure relates generally to connectors and, more particularly, to fastening tools for connectors and methods of fastening connectors.

BACKGROUND

Some connection assemblies include a male connector and a female connector. In such instances, the male connector has one or more protruding members, such as pins or prongs, while the female connector has a complimentary number of receptacles to receive the protruding members of the male connector. Electrical signals are typically transmitted between the male and female connectors via the pins and the receptacles when the connectors are mated. Reliability of the signal communication via the connectors depends on a quality of the connection between the male connector and the female connector. For example, when the pins of the male connector are not properly aligned with the receptacles of the female connector, signals may become degraded when transmitted over the connection between the connectors.

SUMMARY

Fastening tools and methods of fastening connectors are disclosed. A first disclosed example apparatus includes a first rail and a second rail parallel to the first rail, wherein the first and second rails are spaced apart to receive a first connector having fasteners spaced apart by a first distance; and a first aperture in the first rail and a second aperture in the second rail, wherein the first and second apertures are spaced apart by the first distance.

Another disclosed example apparatus includes a first leg including a first output shaft having a first screwdriver head; a second leg including a second output shaft having a second screwdriver head; an input shaft to rotate the first and second output shafts at the same time; and an adjuster to vary a distance between the first and second output shafts.

Another disclosed example apparatus includes an input shaft coupled to a gear train; a first output shaft coupled to the gear train, the first output shaft including a first screwdriver head; and a second output shaft coupled to the gear train, the second output shaft including a second screwdriver head, wherein the gear train is to rotate the first and second output shafts simultaneously in response to a rotation of the input shaft.

A disclosed example method includes positioning a first connector between a first rail and a second rail of an alignment assembly; positioning a second connector between the first and second rails; and inserting first and second output shafts of a synchronized screwdriver into apertures of the alignment assembly, wherein the apertures are aligned with fasteners of the first connector

Figure 1:
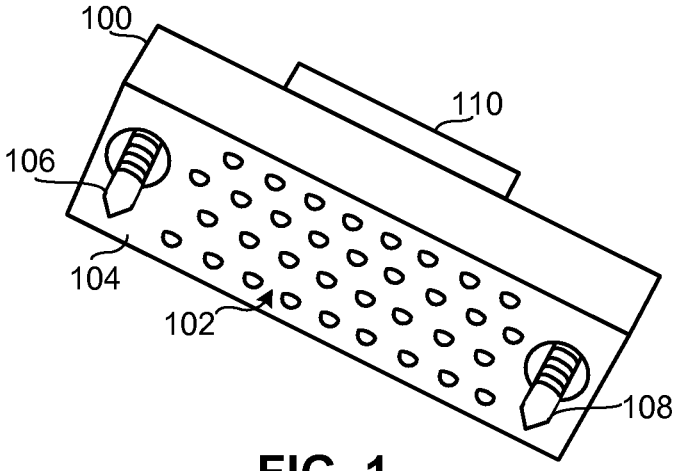
FIG. 1 (PRIOR ART)
FIG. 1 is an illustration of an example female connector.

To clarify multiple layers and regions, the thicknesses of the layers are enlarged in the drawings. Accordingly, the structures illustrated in the drawings are not drawn to scale and, instead, are drawn to clarify the teachings of this disclosure. Wherever possible, the same reference numbers will be used throughout the drawing(s) and accompanying written description to refer to the same or like parts. As used in this patent, stating that any part (e.g., a layer, film, or area) is in any way positioned on (e.g., positioned on, located on, disposed on, attached to, or formed on, etc.) another part, means that the referenced part is either in contact with the other part, or that the referenced part is adjacent the other part with one or more intermediate part(s) located therebetween. Stating that any part is in contact with another part means that there is no intermediate part between the two parts.

DETAILED DESCRIPTION

FIG. 1 shows an example female connector 100 including a plurality of receptacles 102 located along a first mating surface 104. The example female connector 100 of FIG. 1 also includes first and second fasteners 106 and 108. In the illustrated example of FIG. 1, the fasteners 106 and 108 are screws. However, additional or alternative types of fasteners can be implemented on the example female connector 100 of FIG. 1.

Figure 2:
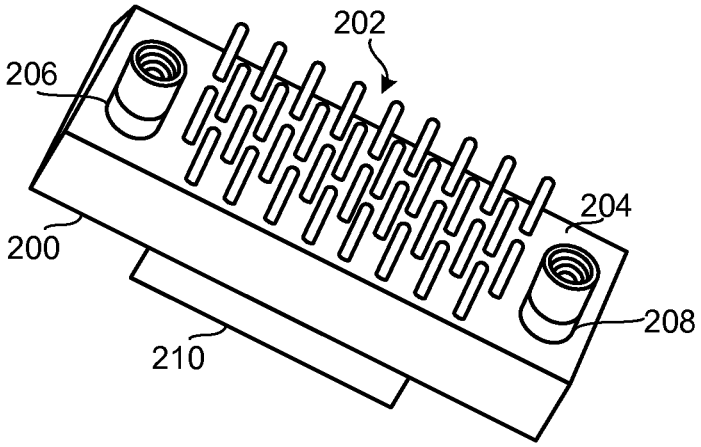
FIG. 2 (PRIOR ART)
FIG. 2 is an illustration of an example male connector.

FIG. 2 shows an example male connector 200 including a plurality of protruding members 202 located along a second mating surface 204. The example male connector 200 of FIG. 2 also includes first and second fastener receptacles 206 and 208. In the illustrated example of FIG. 2, the protruding members 202 are metallic pins capable of carrying electrical signals. However, additional or alternative types of communication members or signal conduits can be implemented on the example male connector 200 of FIG. 2. In the illustrated example of FIG. 2, the fastener receptacles 206 and 208 are threaded receptacles configured to receive the screws 106 and 108 of FIG. 1. However, additional or alternative types of fastener receptacles can be implemented on the example male connector 200 of FIG. 2 depending on, for example, the type and/or configuration of the complimentary fasteners provided on the female connector 100.

The receptacles 102 of the female connector 100 of FIG. 1 are complimentary to the pins 202 of the male connector of FIG. 2. Thus, when the female connector 100 of FIG. 1 is mated with the male connector 200 of FIG. 2, the pins 202 of the male connector 200 are inserted into the receptacles 102 of the female connector 100. Electrical signals may be transmitted between the female and male connectors 100 and 200 when the pins 202 of the male connector 200 are properly mated with the complimentary receptacles 102 of the female connector 100. Each of the pins 202 may carry a signal that is mapped to a corresponding one of the receptacles 102 of the female connector 100.

Further, the fastener receptacles 206 and 208 of the male connector 200 are complimentary to the fasteners 106 and 108 of the female connector 100. Thus, when the female connector 100 of FIG. 1 is mated with the male connector 200 of FIG. 2, the fasteners 106 and 108 of the female connector 100 are inserted (e.g., threaded) into the fastener receptacles 206 and 208 of the male connector 200. Alternatively, the example female connector 100 can include fastener receptacles and the male connector 200 can include fasteners. The fasteners 106 and 108 are tightened into the fastener receptacles 206 and 208 to maintain the male connector 200 in mated engagement to the female connector 100. Further, the fasteners 106 and 108 are loosened from the fastener receptacles 206 and 208 to enable a user to pull the male connector 200 and the female connector 100 apart.

The receptacles 102 of the female connector 100 are coupled to signal carrying media, such as wires. In some examples, the signal carrying media are housed in a potting 110. Similarly, the pins 202 of the male connector 200 are coupled to signal carrying media, such as wires, which may be housed in a potting 210. The potting 110 and 210 of FIGS. 1 and 2, respectively, can be coupled to, for example, a computing device, an input/output device, a sensor, a sensor array, etc. For signals to be carried across the connection created by the mated connectors 100 and 200, the pins 202 need to be properly seated in the receptacles 102. Improper seating or mating between the pins 202 and the receptacles 102 can cause loss of data being carried over the signal carrying media coupled to the connectors 100 and 200.

Figure 3:
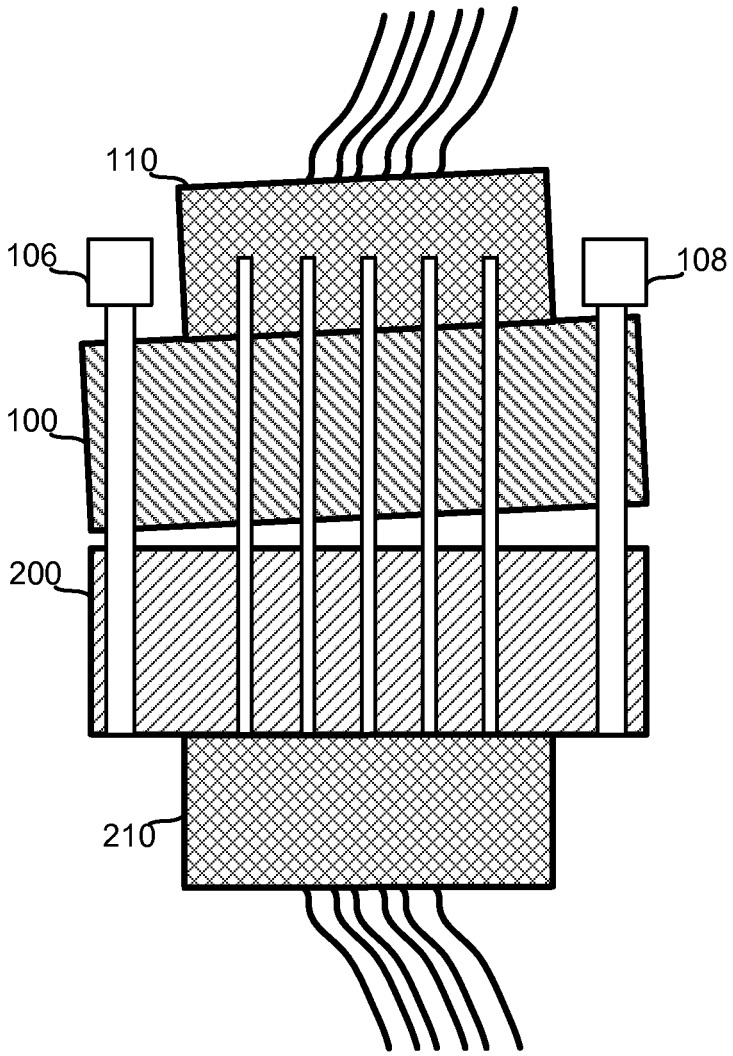
FIG. 3 (PRIOR ART)
FIG. 3 is a diagram illustrating a skewed or misaligned mating of the example female connector of FIG. 1 and the example male connector of FIG. 2.

FIG. 3 shows an example scenario in which improper mating of the connectors 100 and 200 creates the potential for data loss. In the example of FIG. 3, the female connector 100 is misaligned with the male connector 200. In particular, the pins 202 of the male connector 200 are seated in the receptacles 102 but the female connector 100 is askew relative to the male connector 200. In other words, the first mating surface 104 of the female connector 100 is not parallel to the second mating surface 204 of the male connector 200. As a result, some of the pins 202 may be inserted into corresponding ones of the receptacles 102 at the proper depth, while other ones of the pins 202 may be seated in corresponding ones of the receptacles 102 at an improper depth (e.g., an undesirably shallow depth). In such instances, one or more of the pins 202 may not be seated far enough into the corresponding receptacle(s) 102 to enable consistent, reliable transfer of signals across the mated female and male connectors 100 and 200.

Additionally or alternatively, when misaligned as shown in FIG. 3, the pins 202 and/or the fasteners 106, 108 may bend when, for example, the connectors 100 and 200 are pulled apart and/or other forces are exerted on the connectors 100, 200 when mated. For example, because at least some of the pins 202 are not coaxially aligned with the corresponding receptacles 202 as shown in FIG. 3, those pins 202 may be making contact with the walls of the receptacles 202 at some points but not otherwise, thereby inducing stress on the pins 202. The pins 202 may not be designed to endure such stresses and the pins 202 may become damaged. Communication failures are more likely to occur in the example scenario shown in FIG. 3, as well as alternative scenarios and/or configurations in which the female and male connectors 100 and 200 are not properly aligned when mated. Other types of damage and miscommunication of signals can result from the misaligned mating of the connectors 100, 200 shown in FIG. 3.

The misalignment scenario shown in FIG. 3 may be caused or worsened by a plurality of factors and/or occurrences. For example, the devices to which the containers 110 and/or 210 are coupled and/or a system in which the connectors 100 and 200 are deployed may experience significant vibrations, accelerations, and/or other movements that impart forces on the female and/or male connectors 100, 200 while the connectors 100, 200 are mated. For example, when the connectors 100, 200 are deployed in a missile guidance system that is installed in a missile, the connectors 100 and 200 will experience significant accelerations and vibrations capable of pulling on one or both of the connectors 100 and 200. As a result, some of the pins 202 may dislodge from the receptacles 102, the pins 202 may damage the receptacles 102 (e.g., by scratching walls of the receptacles 102), the pins 202 may become damaged, the mating of the female connector 100 to the male connector 200 may become askew, wear and tear may be accelerated, the fasteners 106 and 108 may bend, etc. Thus, proper alignment of the connectors 100 and 200 is important to proper and efficient performance.

In some instances, the misalignment between the mated connectors 100 and 200 shown in FIG. 3 is caused during fastening of the fasteners 106 and 108 into the fastener receptacles 206 and 208 after or as the pins 202 are inserted into the receptacles 102. For example, the first fastener 106 may be tightened (e.g., by a screwdriver) into the first fastener receptacle 206 more (e.g., turned a greater number of revolutions or revolution fractions) than the second fastener 108 is tightened into the second fastener receptacle 208. In that case, a first side of the female connector 100 on which the first fastener 106 is located is closer to the male connector 200 than a second side of the female connector 100 on which the second fastener 108 is located. In other words, uneven tightening of the fasteners 106 and 108 can cause the skewed mating of the connectors 100 and 200 as shown in FIG. 3.

Additionally or alternatively, the misalignment between the mated connectors 100 and 200 shown in FIG. 3 can be caused during insertion of the pins 202 of the male connector 200 into the receptacles 102 of the female connector 100. In other words, before the fasteners 106 and 108 are tightened, the female connector 100 may not be properly aligned with the male connector 200. In that case, despite even tightening of the fasteners 106 and 108, the skewed alignment of the connectors 100 and 200 shown in FIG. 3 may result. That is, if a first side or portion of the pins 202 are inserted further into the receptacles 102 than a second side or portion of the pins 202 before (or after) the fasteners 106 and 108 are tightened, then a first side of the female connector 100 corresponding to the first side or portion of the pins 202 is susceptible to being mated further onto the pins 202 than a second side of the female connector 100 corresponding to the second side or portion of the pins 202.

Example apparatus and methods disclosed herein ensure proper mated alignment of connectors. In particular, the example apparatus disclosed herein include synchronized screwdriver assemblies that enable a user to tighten and loosen connector fasteners in a synchronized fashion. Example synchronized screwdriver assemblies disclosed herein include an input shaft that simultaneously rotates two output shafts that have screwdriver heads. As a user rotates the input shaft of example synchronized screwdriver assemblies disclosed herein, the screwdriver heads of the two output shafts evenly tighten and loosen the fasteners (e.g., screws) of one connector with the counterpart fastener receptacles of a counterpart connector.

Example apparatus disclosed herein also include connector alignment assemblies to ensure proper alignment of male and female connectors during mating and separation of the connectors and fastening and loosening of the connectors. Example connector alignment assemblies disclosed herein include guide rails along which the individual connectors are placed before the connectors are mated together or separated. As the connectors are mated or separated, the example connector alignment assemblies disclosed herein maintain the connectors in a fixed position relative to each other along an axis such that the mating surfaces of the connectors remain substantially (e.g., within a threshold) parallel during the mating process and the separation process. Further, the guide rails of the example connector alignment assemblies disclosed herein maintain the connectors in the fixed position during the fastening and loosening of the male connector and the female connector. Thus, use of the example connector alignment assemblies disclosed herein during the mating or separation process of the connectors ensures that the connectors are properly aligned during and after the mating or separation process.

For purposes of illustration and not limitation, example apparatus and methods disclosed herein are described in connection with the example female connector 100 of FIG. 1 and the example male connector 200 of FIG. 2. However, example apparatus and methods disclosed herein can be utilized and/or deployed in connection with any type of connectors and/or fasteners.

Figure 4:
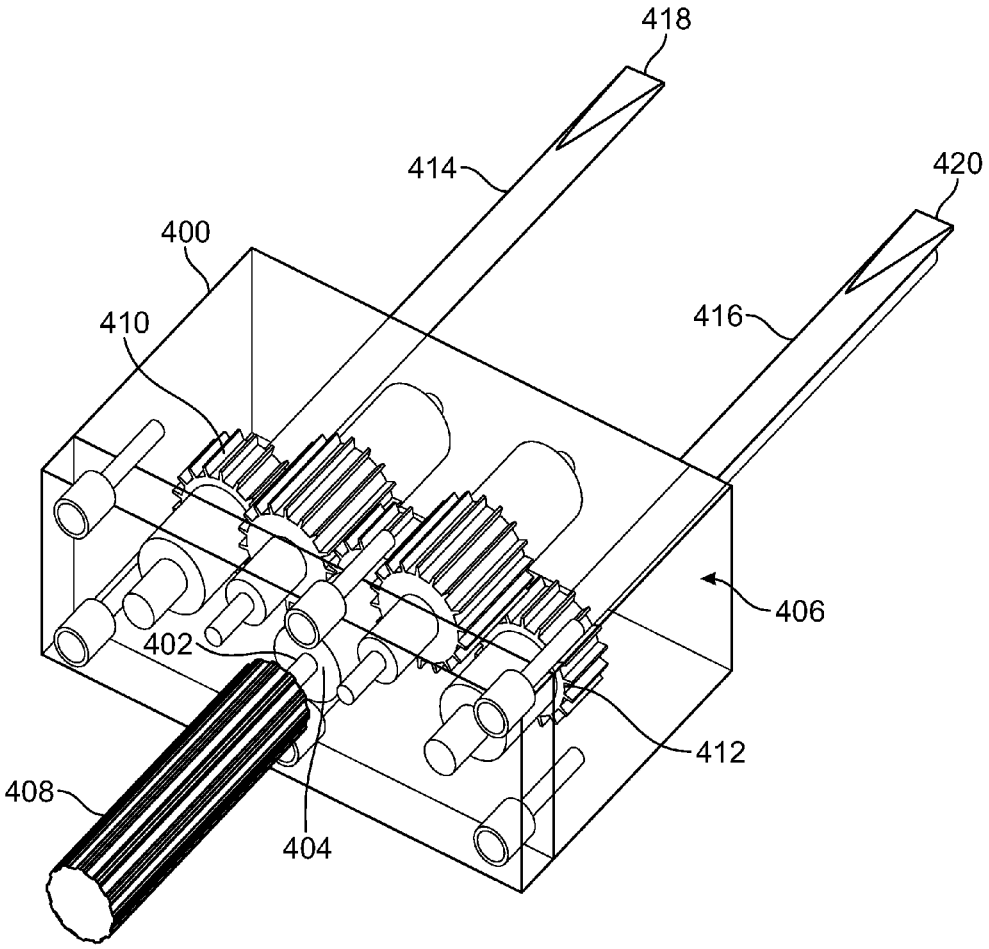
FIG. 4 depicts a first example screwdriver assembly constructed in accordance with teachings of this disclosure.

FIG. 4 is an image of an example screwdriver assembly 400 constructed in accordance with teachings of this disclosure. The example screwdriver assembly 400 of FIG. 4 includes an input shaft 402 that drives a central gear 404 of a gear train 406. The input shaft 402 is coupled to a handle 408 that is designed to be grasped by a user and rotated in a clockwise and a counterclockwise rotational direction to drive the input shaft 402. In some examples, the handle 408 is knurled to improve a grip of the handle 408 by the user.

The example gear train 406 of FIG. 4 includes a first outer gear 410 and a second outer gear 412 that are each communicatively coupled to the central gear 404. As the user rotates the handle 408, the input shaft 402 rotates the central gear 404, which rotates the first and second outer gears 410 and 412. In some examples, the central gear 404 is in direct contact with the outer gears 410 and 412. Alternatively, the central gear 404 can rotate one or more levels of intermediate gears such that the central gear 404 indirectly drives rotations of the outer gears 410 and 412. Thus, the example configuration of the gear train 406 of FIG. 4 is an example configuration and additional or alternative configurations are possible.

As the input shaft 402 rotates the central gear 404, the first and second outer gears 410 and 412 are respectively rotated simultaneously at the same speed or rate (e.g., revolutions per second). Each of the outer gears 410 and 412 is each coupled to a respective output shaft 414 and 416. Thus, as the outer gears 410 and 412 rotate, the output shafts 414 and 416 rotate simultaneously. The output shafts 414 and 416 include screwdriver heads 418 and 420 of any suitable type (e.g., hex, flat head, Phillips, etc.). In some examples, the type of screwdriver head fitted on (or made integrally with) the output shafts 414 and 416 may be customized for a particular type of connector.

Further, the distance between the output shafts 414 and 416 is also customizable to match the distance between the fasteners of particular connectors. That is, different types of connectors having fasteners spaced apart different amounts. The example screwdriver assembly 400 of FIG. 4 can be designed and constructed such that the distance between the output shafts 414 and 416 matches the distance between fasteners of a particular type of connector. An alternative example screwdriver assembly disclosed herein, in which the distance between the output shafts 414 and 416 is adjustable, is described below in connection with FIGS. 7-11.

When a user desires to mate or decouple complimentary connectors, such as the female and male connectors 100 and 200 of FIGS. 1 and 2, the user can use the example screwdriver assembly 400 of FIG. 4 to ensure that the fasteners 106 and 108 of the female connector 100 are rotated simultaneously into the receptacles 206 and 208 of the male connector 200. In particular, the screwdriver heads 418 and 420 are inserted into grooves of the heads of the fasteners 106 and 108 when, for example, the pins 202 of the male connector 200 have at least partially engaged the receptacles 102 of the female connector 100. With the screwdriver heads 418 and 420 engaged with the heads of the fasteners 106 and 108, the user rotates the handle 408 to tighten the screws to the fastener receptacles 206 and 208. As described above, rotation of the handle 408 causes the gear train 406 to rotate the output shafts 414 and 416 simultaneously, typically in a clockwise direction for tightening the fasteners 106 and 108. As a result, the first fastener 106 and the second fastener 108 are rotated the same amount (e.g., revolutions) at the same time, thereby placing a substantially equal amount of fastener force on each side of the connectors 100 and 200 when the connectors 100 and 200 are mated.

Similarly, when the connectors 100 and 200 are to be separated or decoupled, the example screwdriver assembly 400 of FIG. 4 can be used to loosen the fasteners 106 and 108 from the fastener receptacles 206 and 208 in a simultaneous fashion, thereby avoiding any uneven stresses being placed on one side of the connectors 100 and 200 or the other. In such instances, the screwdriver heads 418 and 420 are placed in the grooves of the fasteners 106 and 108 and the handle 408 is rotated by the user. As described above, rotation of the handle 408 causes the gear train 406 to drive the output shafts 416 and 418 to rotate, typically in a counterclockwise direction to loosen the fasteners 106 and 108.

Figure 5:
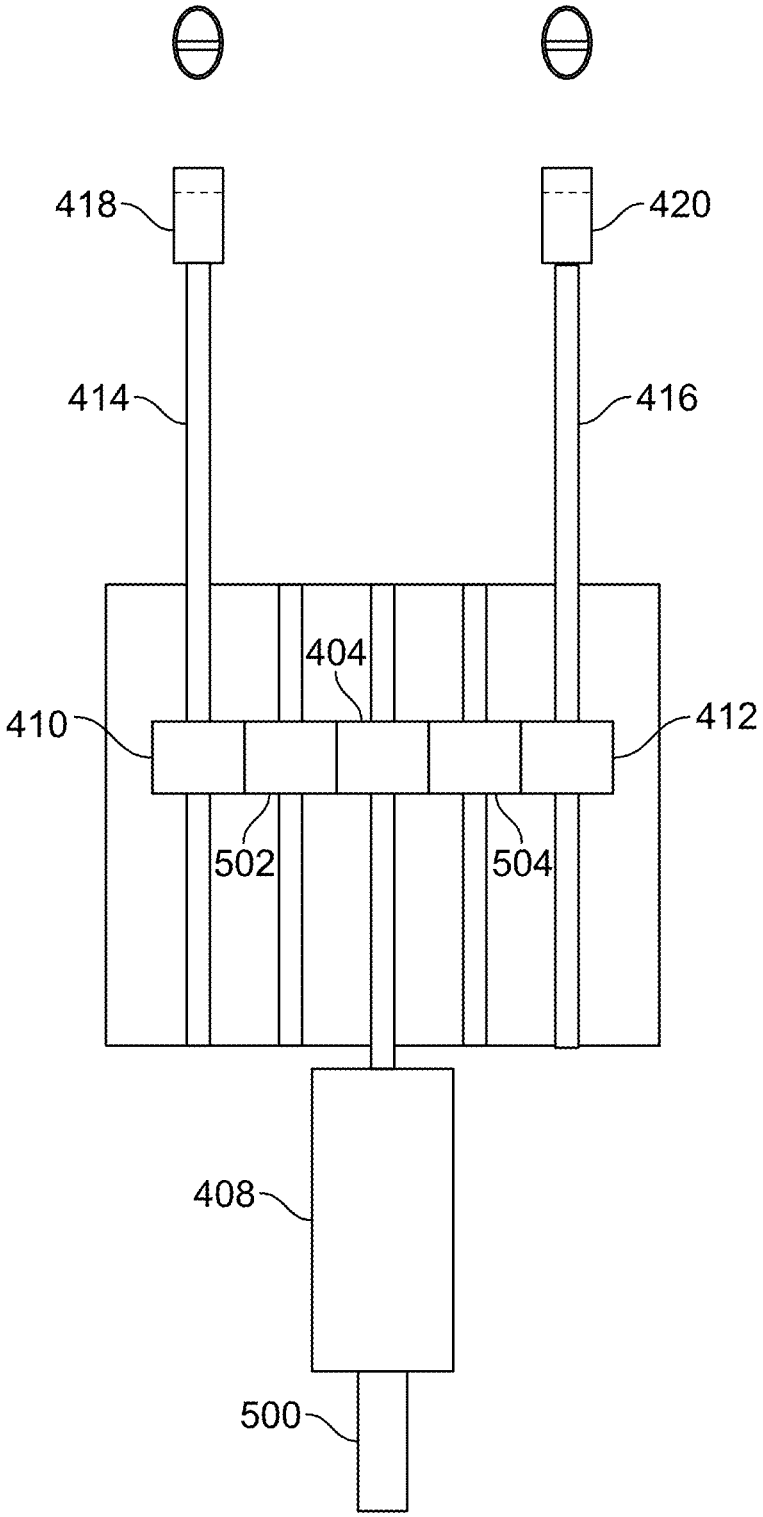
FIG. 5 is a schematic illustration of the first example screwdriver assembly of FIG. 4.

FIG. 5 is a schematic illustration of the screwdriver assembly 400 of FIG. 4. In the illustrated example of FIG. 5, the handle 408 includes a quick turn knob 500 that can be rotated by the user at a different rate than the handle 408. Like the handle 408, the example quick turn knob 500 of FIG. 5 drives the central gear 404 of the gear train 406. The example quick turn knob 500 has a smaller diameter than the larger portion of the handle 408. As a result, the user complete full rotations of the knob 500 faster than the handle 408. The example of FIG. 5 also shows first and second intermediate gears 502 and 504 of the gear train 406. The example intermediate gears 502 and 504 are in contact with the central gear 404 and have teeth that engage the teeth of the central gear 404. The example intermediate gears 502 and 504 of FIG. 5 are also in contact with the outer gears 410 and 412. Thus, the central gear 404 drives the intermediate gears 502 and 504 to rotate which, in turn, cause the outer gears 410 and 412 to rotate.

Figure 6:
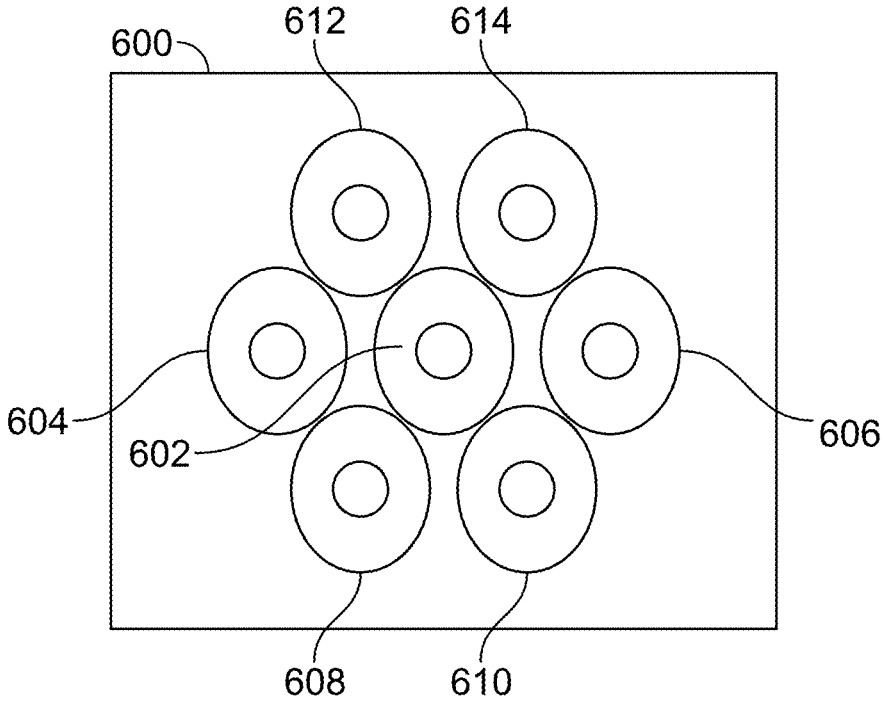
FIG. 6 is a schematic illustration of the example gear box of FIGS. 4 and/or 5.

FIG. 6 shows a cross-sectional view of an alternative gear train 600 that can be used in conjunction with the example screwdriver assembly 400 of FIG. 4. Similar to the example gear train 406 shown in FIGS. 4 and 5, the example gear train 600 of FIG. 6 includes a central gear 602 that is coupled to a handle (e.g., the example handle 408 of FIGS. 4 and 5) and outer gears 604 and 606 that are coupled to output shafts (e.g., the example output shafts 414 and 416 of FIGS. 4 and 5). The example gear train 600 of FIG. 6 includes four intermediate gears 608-614 that are driven by the central gear 602 and which drive the outer gears 604 and 606. For example, when the user causes the central gear 602 to rotate clockwise (e.g., by turning the handle 408), the intermediate gears 608-614 are caused to rotate counterclockwise. In turn, the intermediate gears 608-614 cause the outer gears 602 and 604 to rotate clockwise (along with the central gear 602). As described above, the rotation of the outer gears 602 and 604 drives rotation of the outer shafts 414 and 416. The example gear train 600 of FIG. 6 and/or additional or alternative gear train designs or configurations can be implemented to, for example, achieve different ratios or torques among the gears.

Figure 7A:
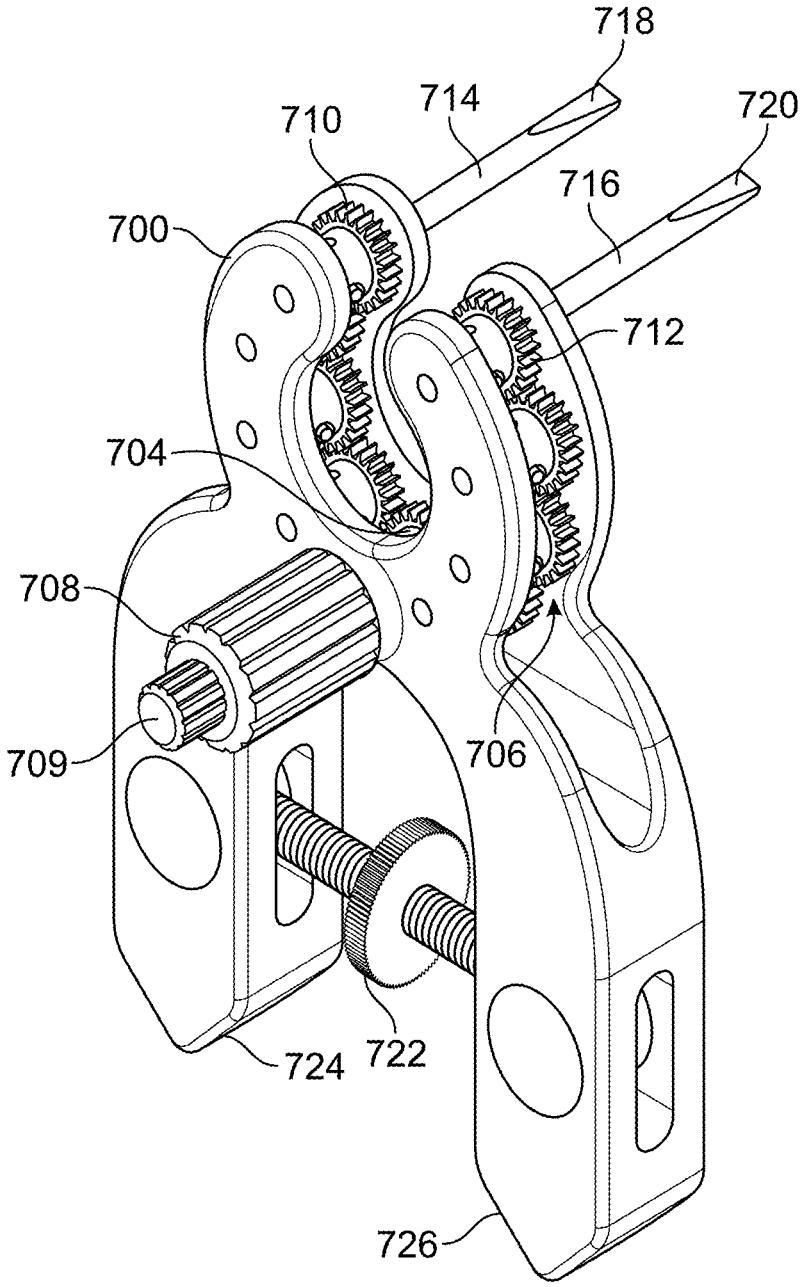
FIG. 7A is an image of a second example screwdriver assembly constructed in accordance with teachings of this disclosure.

FIG. 7A shows another example screwdriver assembly 700 constructed in accordance with the teachings of this disclosure. The example screwdriver assembly 700 of FIG. 7A includes an input shaft 702 (FIG. 7C) coupled to a knurled rotatable handle 708 to rotate (e.g., clockwise and counterclockwise) the input shaft 702. The example handle 708 of FIG. 7A includes a quick turn knob 709 similar to the quick turn knob 500 described above in connection with FIG. 5. As described above, the quick turn knob 500 has a smaller diameter to enable the user to rotate the input shaft 702 at a greater speed or rate. The example input shaft 702 is press-fitted into a central gear 704 of a gear train 706. The example gear train 706 of FIG. 7A includes a first outer gear 710 and a second outer gear 712 that are each operatively coupled to the central gear 704 via intermediate gears of the gear train 706. The intermediate gears of the gear train 706 transfer torque applied to the handle 708 to the outer gears 710 and 712. Further, the outer gears 710 and 712 are coupled to respective output shafts 714 and 716 having respective screwdriver heads 718 and 720 of any suitable type (e.g., hex, flat head, Phillips, etc.). Thus, as described in greater detail above in connection with FIG. 4, as the user turns the handle 708, the input shaft 702 rotates the central gear 704, which causes the gear train 706 to simultaneously drive the first and second outer gears 710 and 712 at a same rate or speed (e.g., revolutions per second). As the outer gears 710 and 712 rotate simultaneously at the same rate, the output shafts 714 and 716 rotate simultaneously at the same rate, thereby turning the screwdriver heads 718 and 720 at an equal rate of rotation.

The example screwdriver assembly 700 of FIG. 7A is adjustable to change the distance between the output shafts 714 and 716. As a result, the screwdriver assembly 700 of FIG. 7A can be used on different types of connectors having different spacings between fasteners (e.g., the fasteners 106 and 108 of FIG. 1) and/or fastener receptacles (e.g., the fastener receptacles 206 and 208 of FIG. 2). In the example of FIG. 7A, adjustment of the distance between the outer gears 710 and 712 (and, thus, the distance between the output shafts 414 and 416) is enabled by an adjuster 722 coupled to a first leg 724 at a first end and a second leg 726 at a second end.

Figures 7B, 7C:
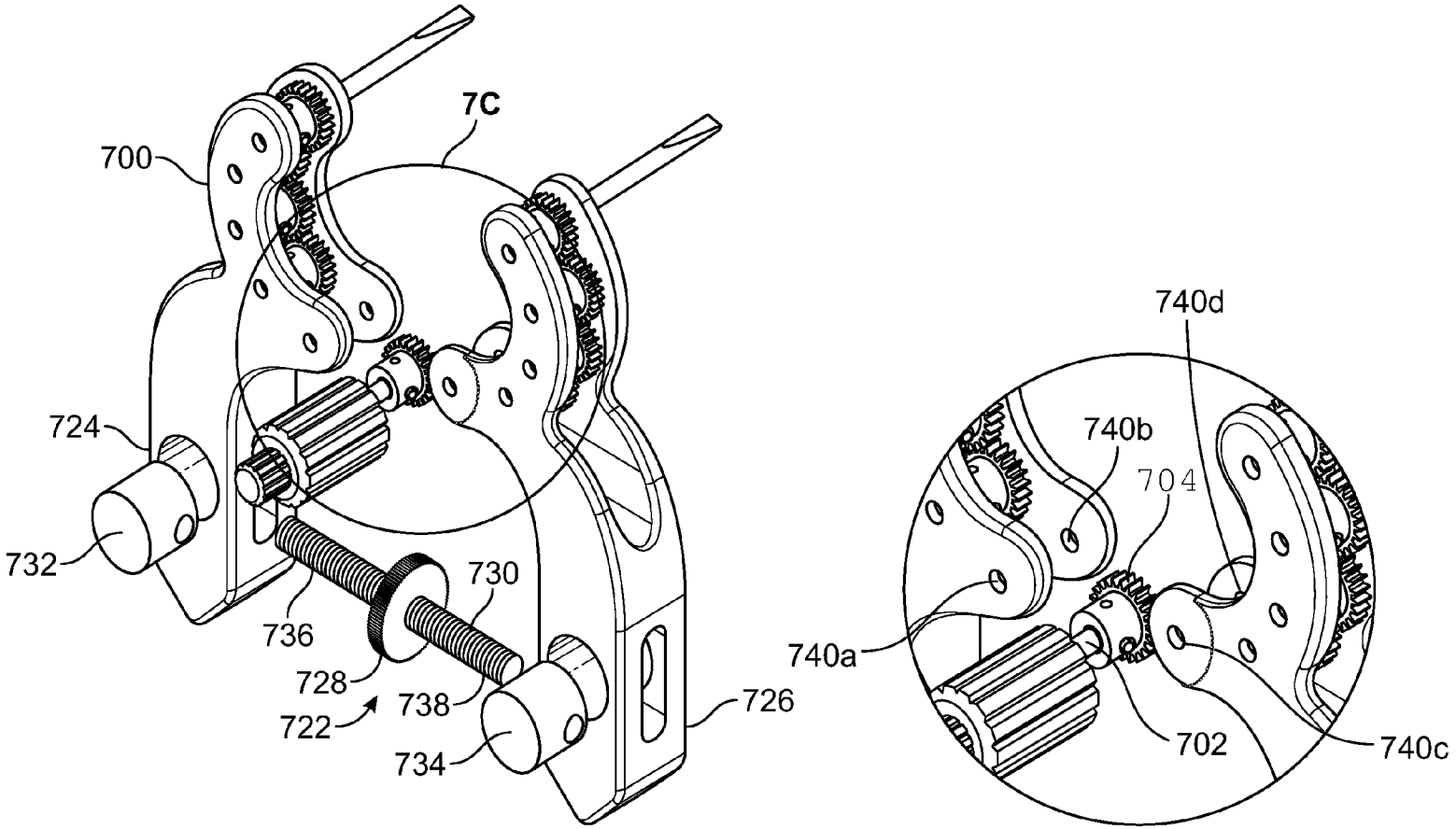
FIG. 7B is an exploded view of the second example screwdriver assembly of FIG. 7A.
FIG. 7C is a magnified view of a portion of the exploded view of FIG. 7B.

FIG. 7B, which is an exploded view of the example screwdriver assembly 700 of FIG. 7A, illustrates the configuration of the adjuster 722 and how the adjuster 722 enables the distance between the output shafts 714 and 716 to be adjusted. As shown in FIG. 7B, the adjuster 722 includes an adjustment wheel 728 and a threaded shaft 730 that is threadably coupled to the legs 724 and 726 via nuts 732 and 734 that are press fitted into cavities in the legs 724 and 726. The threaded shaft 730 has a left hand thread on a first portion 736 between the wheel 728 and the first leg 724, and a right hand thread on a second portion 738 between the wheel 728 and the second leg 724. In the illustrated example, the wheel 728 is fixed to the threaded shaft 730 such that rotation of the wheel 728 rotates the first and second portions 736 and 738 in the same direction. As a result, when the user turns the wheel 728 in a first direction (e.g., clockwise), the opposing directions of the threads of the first and second portions 736 and 738 of the threaded shaft 730 draw the legs 724 and 726 together. Conversely, when the user turns the wheel 728 in a second, opposite direction (e.g., counterclockwise), the opposing directions of the threads of the first and second portions 736 and 738 of the threaded shaft 730 push the legs 724 and 726 apart. The nuts 732 and 734 are threaded such that the first and second portions 736 and 738 can move into and out of the nuts 732 and 734, thereby allowing the first and second legs 724 and 726 to travel toward and away from each other.

As shown in FIG. 7C, the first leg 724 is coupled to the second leg 726 by inserting the input shaft 702 into holes 740*a-d* in the first and second legs 724 and 726 while the holes 740*a-d* are aligned with each other. As a result, when assembled, the first leg 724 and the second leg 726 share a pivot point at the center of the input shaft 702. When the user turns the wheel 728 of the adjuster 722 in a direction (e.g., clockwise) that spreads the legs 724 and 726 apart, the pivot point created by the input shaft 702 and the holes 740*a-d* causes the outer gears 710 and 712 to move toward each other. Conversely, when the user turns the wheel 728 of the adjuster 722 in an opposite direction (e.g., counterclockwise) that pulls the legs 724 and 726 closer together, the pivot point causes the outer gears 710 and 712 to move apart. Thus, the example adjuster 722 enables use of the example screwdriver assembly 700 in conjunction with both a first type of connector having fasteners spaced at a first distance and a second type of connector having fasteners spaced at a second distance different than that first distance.

Figures 7D, 7E:
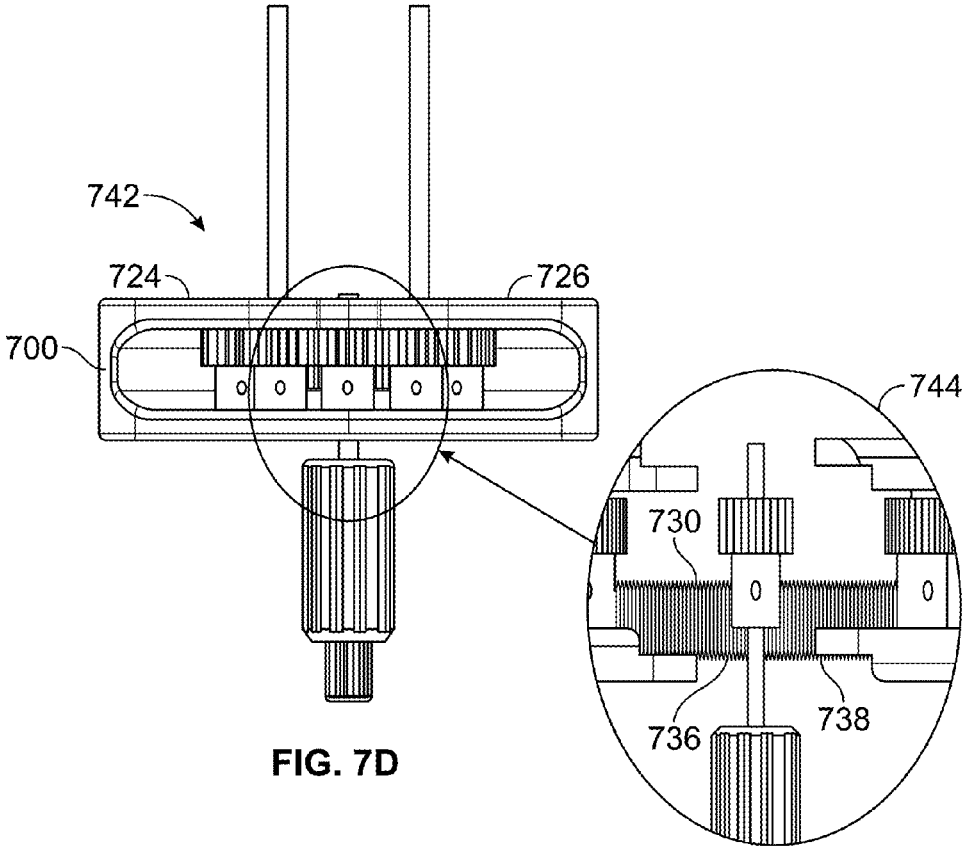
FIG. 7D is another view of the second example screwdriver assembly of FIG. 7A.
FIG. 7E is an exploded view of a portion of the view of FIG. 7D.

FIGS. 7D and 7E provide another view of the example screwdriver assembly 700 of FIGS. 7A, 7B and 7C. FIG. 7D depicts a first view 742 of the screwdriver assembly 700 in an assembled state with the first leg 724 coupled to the second leg 726. That is, FIG. 7D shows the input shaft 702 inserted into the pivot holes 740*a-d*. FIG. 7E depicts a second view 744 of the screwdriver assembly 700 is a disassembled state with the first leg 724 not coupled to the second leg 726. The second view 744 of FIG. 7C illustrates the opposing threads of the first portion 736 and the second portion 738 of the threaded shaft 730.

Figure 7F:
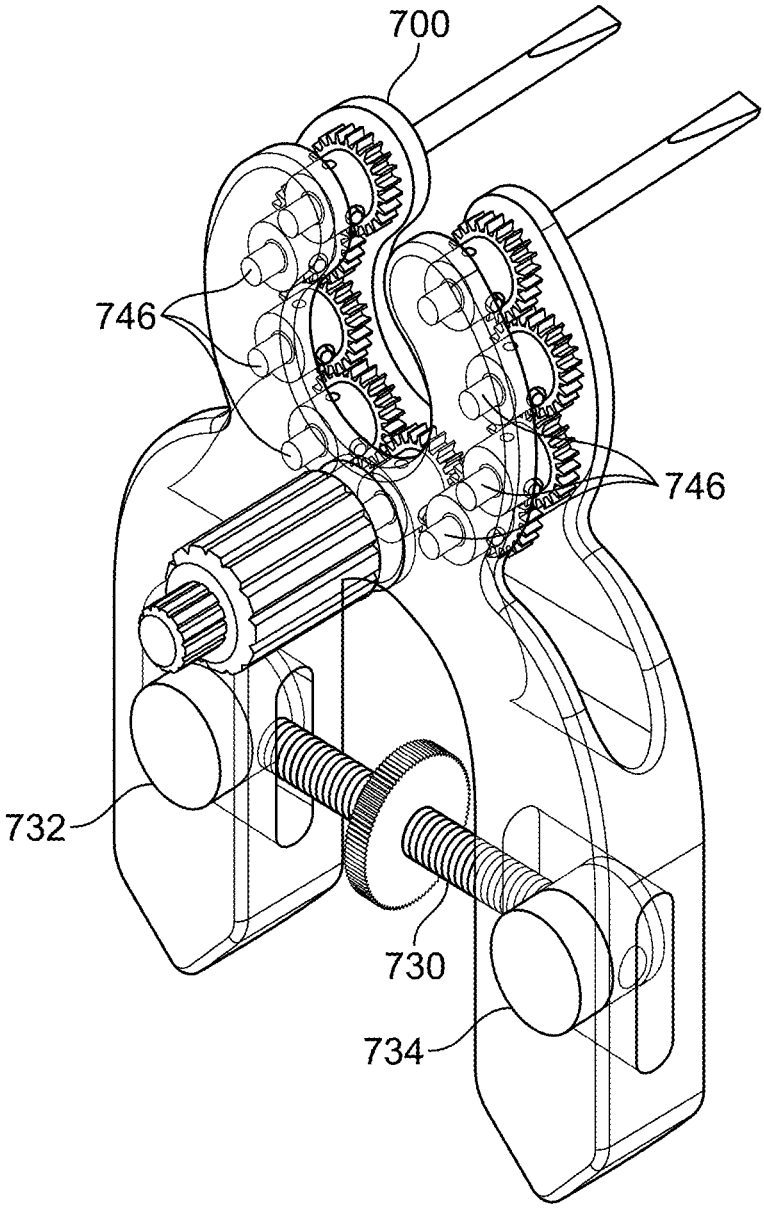
FIG. 7F is another image of the second example screwdriver assembly of FIG. 7A.

FIG. 7F is another view of the example screwdriver assembly 700 of FIGS. 7A-E. FIG. 7F shows the threaded shaft 730 inserted into the nuts 732 and 734. As described above, the threaded shaft 730 travels within the nuts 732 and 734 to allow relative movement of the legs 724 and 726. FIG. 7F also shows a plurality of posts or axles 746 onto which the intermediate gears of the gear train 706 are placed and held. The posts 746 are press fit into holes of the legs 724 and 726 (as shown in FIG. 7A).

Figure 7G:
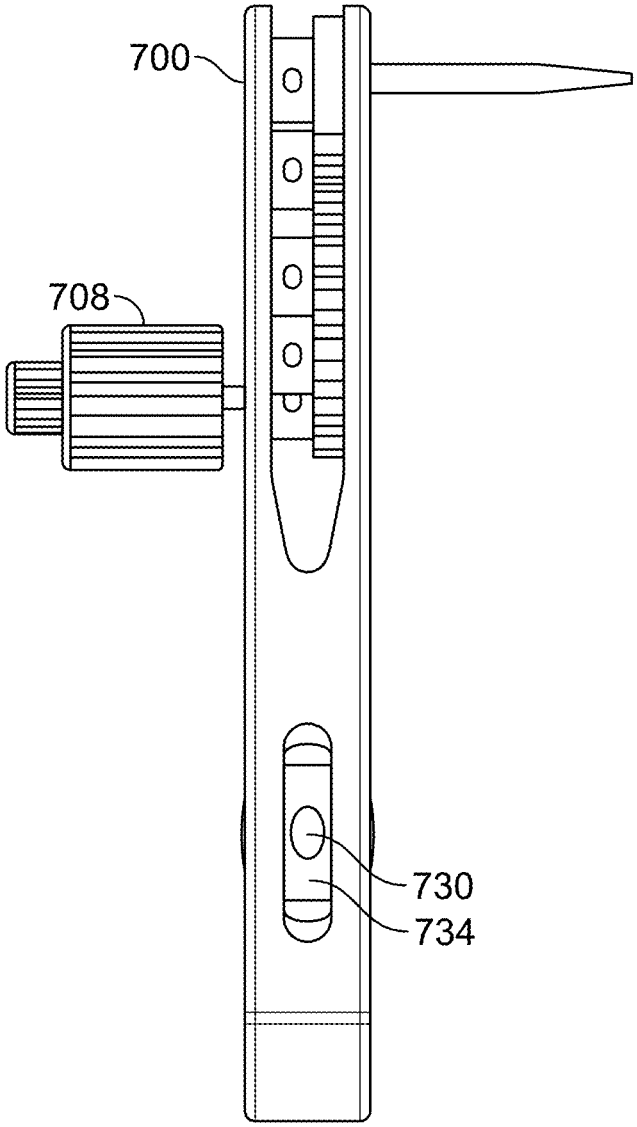
FIG. 7G is another image of the second example screwdriver assembly of FIG. 7A.

FIG. 7G is a side view of the example screwdriver assembly 700 of FIGS. 7A-F. of FIG. 7G shows the threaded shaft 730 inserted into the second nut 734. The second nut 734 includes a threaded aperture to threadably engage the threaded shaft 730 to enable the shaft 730 to travel through the nut 734 as the wheel 728 is turned.

Additional or alternative techniques to adjust the distance between the output shafts of the examples disclosed herein can be used depending on, for example, the configuration of the gear train and the configuration and/or number of intermediate gears.

Figure 8:
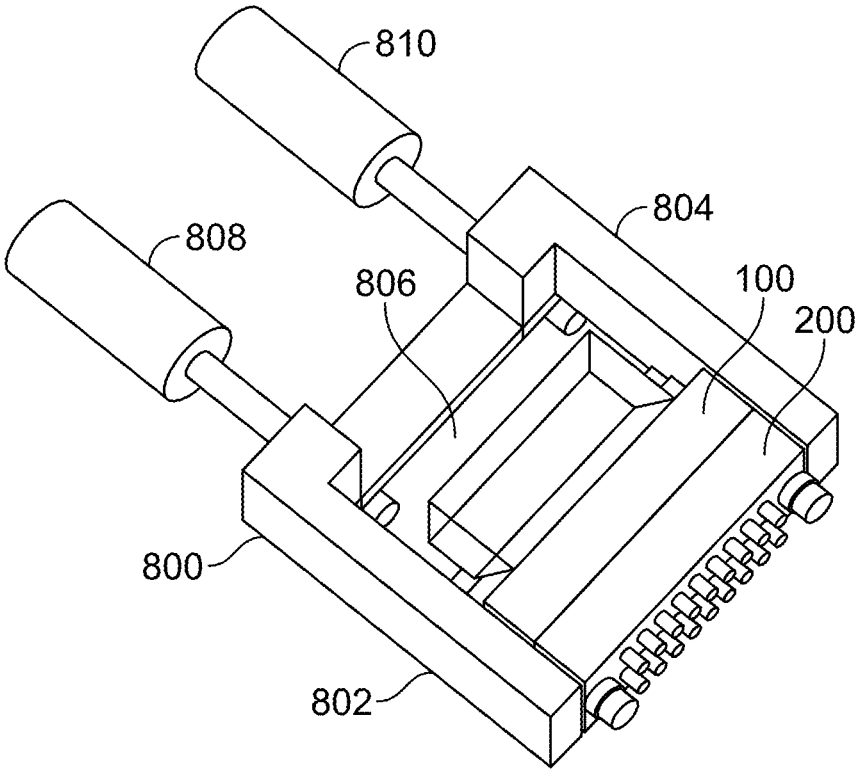
FIG. 8 is an image of an example connector alignment assembly constructed in accordance with teachings of this disclosure.

FIG. 8 is an illustration of an example connector alignment assembly 800 constructed in accordance with the teachings of this disclosure. The example connector alignment assembly 800 of FIG. 8 receives, for example, the female connector 100 of FIG. 1 and the male connector 200 of FIG. 2 separately (in a decoupled state) to facilitate mating of the female connector 100 and the male connector 200. Additionally, the example connector alignment assembly 800 of FIG. 8 receives the female connector 100 and the male connector 200 in a mated state (e.g., coupled together) to facilitate decoupling of the female connector 100 from the male connector 200. The example connector alignment assembly 800 ensures that the connectors 100 and 200 remain in alignment during both the mating and decoupling process. In doing so, the example connector alignment assembly 800 prevents uneven and, thus, excessive stresses on the components of the connectors 100 and 200, such as the receptacles 102 of the female connector 100 and the pins 202 of the male connector 200. Further, the example connector alignment assembly 800 ensures that the connectors 100 and 200 are aligned when mated to prevent problems caused by misalignment of the connectors (e.g., unreliable communication, degraded service of data transmission, damage, accelerated wear and tear, etc.).

The example connector alignment assembly 800 of FIG. 8 includes first and second rails 802 and 804 between which the connectors 100 and 200 are inserted (e.g., in a mated state or in a decoupled state). The rails 802 and 804 are spaced at a distance to enable a friction fit of the connectors 100 and 200 between the rails 802 and 804. The spacing between the rails 802 and 804 can be customized for different sized connectors. When one of the connectors, such as the female connector 100 is placed between the rails 802 and 804, thereby engaging the inner surfaces of the rails 802 and 804, the mating surface 104 of the female connector 100 is held along a specific plane (e.g., perpendicular to a lengthwise axis of the rails 802 and 804). The example connector alignment assembly 800 of FIG. 8 also includes a panel 806 coupled to the rails 802 and 804. In the illustrated example, the example panel 806 is a piece of plastic that is attached (e.g., via rivet(s)) to the outer surfaces of the rails 802 and 804 such that the panel 806 does not interfere with the insertion of the connectors 100 and 200 between the rails 802 and 804. Rather, the panel 806 supplements the alignment of the connectors 100 and 200 provided by the rails 802 and 804.

Thus, when using the example connector alignment assembly 800 to mate the female and male connectors 100 and 200, one of the connectors 100, 200 is inserted into the assembly 800 by sliding that connector 100, 200 between the rails 802 and 804. The counterpart connector 100, 200 is then inserted into the assembly 800 by sliding that connector 100, 200 between the rails 802 and 804 until the pins 202 of the male connector 200 are at least partially inserted into the receptacles 102 of the female connector 100. Because the rails 802 and 804 restrict movement of the connectors 100 and 200, the mating surface 104 of the female connector 100 and the mating surface 204 of the male connector 200 are held in a plane (e.g., perpendicular to a lengthwise axis of the rails 802 and 804). The plane of the mating surface 104 of the female connector 100 and the plane of the mating surface 204 of the male connector 200 are parallel to each other due to the example connector alignment assembly 800. While the mating surfaces 104 and 204 are parallel, first and second screwdrivers 808 and 810 are used to engage the fasteners 106, 108 of the female connector 100 and to tighten the fasteners 106, 108 into the fastener receptacles 206, 208 of the male connector 200. Thus, by using the example connector alignment assembly 800 of FIG. 8, the connectors 100 and 200 are fastened together while the connectors 100 and 200 are in proper alignment. Thus, the example connector alignment assembly 800 prevents problems caused by the connectors 100 and 200 being misaligned while being mated and/or fastened (as described above in connection with FIG. 3).

When using the example connector alignment assembly 800 to decouple the female and male connectors 100 and 200, the mated connectors 100 and 200 are inserted into the assembly 800 by sliding the mated connectors 100 and 200 between the rails 802 and 804. Because the rails 802 and 804 restrict movement of the connectors 100 and 200, the mating surface 104 of the female connector 100 and the mating surface 204 of the male connector 200 are held in a plane (e.g., perpendicular to a lengthwise axis of the rails 802 and 804). The plane of the mating surface 104 of the female connector 100 and the plane of the mating surface 204 of the male connector 200 are parallel to each other. While the mating surfaces 104 and 204 are parallel, the first and second screwdrivers 806 and 808 are used to disengage the fasteners 106, 108 of the female connector 100 from the fastener receptacles 206, 208 of the male connector 200. The connectors 100 and 200 are then pulled apart until the pins 202 of the male connector 200 are completely removed from the receptacles 102 of the female connector 100. The connectors 100 and 200 are then slid out from the rails 802 and 804 separately. As a result, the connectors 100 and 200 are unfastened and decoupled while the connectors 100 and 200 are in proper alignment. Thus, the example connector alignment assembly 800 prevents problems caused by the connectors 100 and 200 being misaligned while being decoupled and/or unfastened (as described above in connection with FIG. 3).

In the illustrated example, the screwdrivers 808 and 810 are inserted into apertures on the rails 802 and 804 that are positioned to align the screwdrivers 808 and 810 with the fasteners 106, 108 when the connector 100 is between the rails 802 and 804. In some examples, the screwdrivers 808 and 810 are fixed and/or removably fixed in the apertures of the rails 802 and 804 such that the screwdrivers 808 and 810 remain in the apertures despite the orientation of the connector alignment assembly 800. That is, the screwdrivers 808 and 810 can be installed such that the screwdrivers 808 and 810 do not fall out of the assembly 800 due to gravity.

Alternatively, the apertures of the rails 802 and 804 can receive alternative screwdrivers. For example, the example screwdriver assemblies 400 and/or 700 of FIGS. 4 and/or 7 can be used in conjunction with the example connector alignment assembly 800 of FIG. 8. In such instances, the output shafts 414 and 416 of FIG. 4 (or 714 and 716 of FIG. 7A) are inserted into the apertures of the rails 802 and 804, which align the output shafts and 416 of FIG. 4 (or 714 and 716 of FIG. 7A) with the fasteners 106, 108 of the connector 100. As described above, the handle 408 of FIG. 4 (or 708 of FIG. 7A) of the screwdriver assembly 400 of FIG. 4 (or 700 of FIG. 7A) can then be turned to simultaneously rotate the fasteners 106, 108 to tighten or loosen the connection between the connectors 100 and 200.

Figure 9:
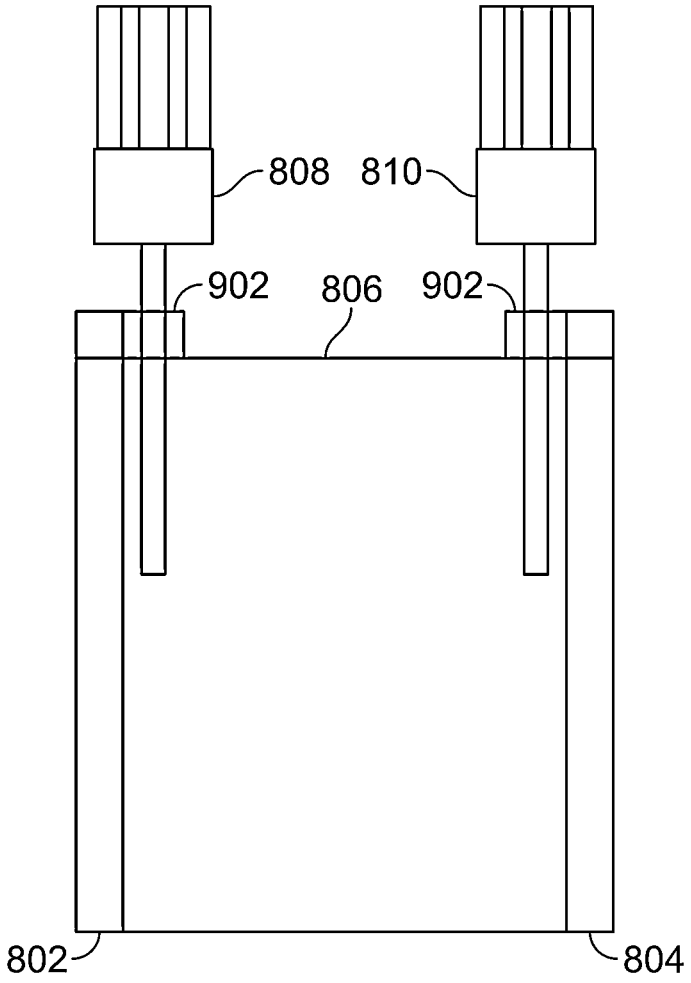
FIG. 9 is a schematic illustration of the example connector alignment assembly of FIG. 8.

FIG. 9 is a schematic representation of the example connector alignment assembly 800 of FIG. 8 without the connectors 100 or 200 inserted between the rails 802 and 804. The example of FIG. 9 shows the panel 806 spanning across the space between the rails 802 and 804. Further, FIG. 9 illustrates apertures 900 and 902 that receive the screwdrivers 808 and 810. Centers of the apertures 900 and 902 are aligned with positions at which the rails 802 and 804 place the centers of the fasteners 106 and 108 of the connector 100. In other words, the apertures 900 and 902 align the screwdrivers 808 and 810 with the center of the fasteners 106 and 108 when the connector 100 is inserted into the rails 802 and 804.

Figure 10A:
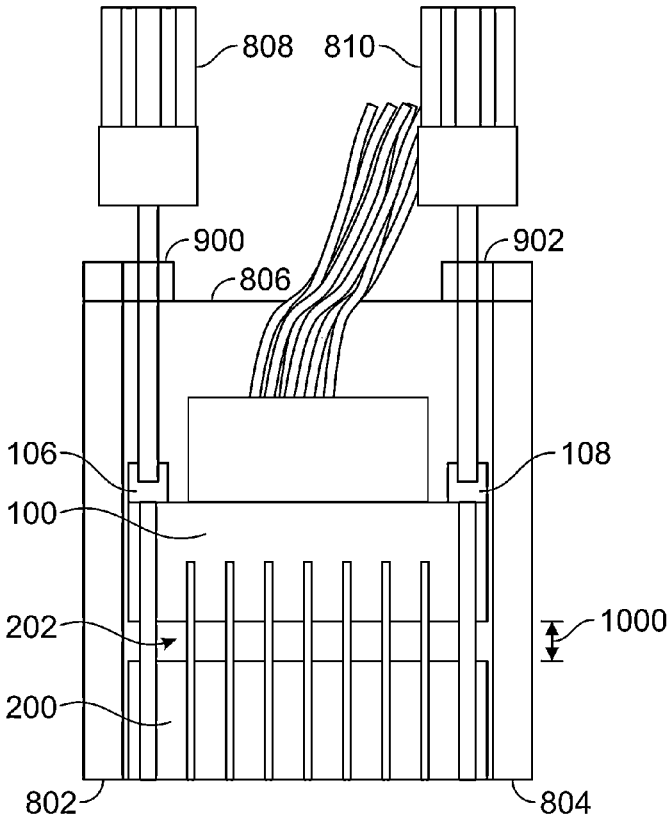
FIG. 10A is another schematic illustration of the example connector alignment assembly of FIG. 8 with the example male and female connectors of FIGS. 1-3 installed therein.

FIG. 10A is another schematic representation of the example connector alignment assembly 800 of FIG. 8 with the connectors 100 and 200 inserted between the rails 802 and 804. As opposed to the misalignment demonstrated in FIG. 3 and described above in connection with FIG. 3, the connectors 100 and 200 in FIG. 10A are aligned properly due to the alignment provided by the rails 802 and 804 and the panel 806 of the example connector alignment assembly 800. In the illustrated example of FIG. 10A, the female connector 100 is not completely mated with the male connector 200 in that the pins 202 of the male connector 200 are not completely inserted into the corresponding receptacles 102 of the female connector 100. The distance between the connectors 100 and 200 is represented in FIG. 10A with reference numeral 1000. To decrease the distance 1000 (and, thus, fully mate the connectors 100 and 200), the screwdrivers 808 and 810, which are aligned with the fasteners 106, 108 due to the apertures 900, 902, are rotated to tighten the fasteners 106, 108. Conversely, to increase the distance 1000 (and, thus, fully decouple the connectors 100 and 200), the screwdrivers 808 and 810 are rotated to loosen the fasteners 106, 108.

Figure 10B:
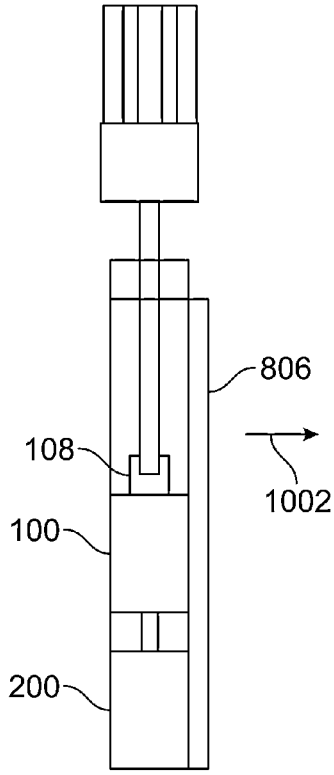
FIG. 10B is another schematic illustration of the example connector alignment assembly of FIG. 8 with the male and female connectors of FIGS. 1-3 installed therein.

FIG. 10B is a side view of the example connector alignment assembly 800 of FIG. 8 showing the connectors 100 and 200 inserted between the rails 802 and 804. As shown in FIG. 10B, the panel 806 restricts the connectors 100 and 200 from moving in a direction represented by reference numeral 1002 in FIG. 10B.

Figure 11:
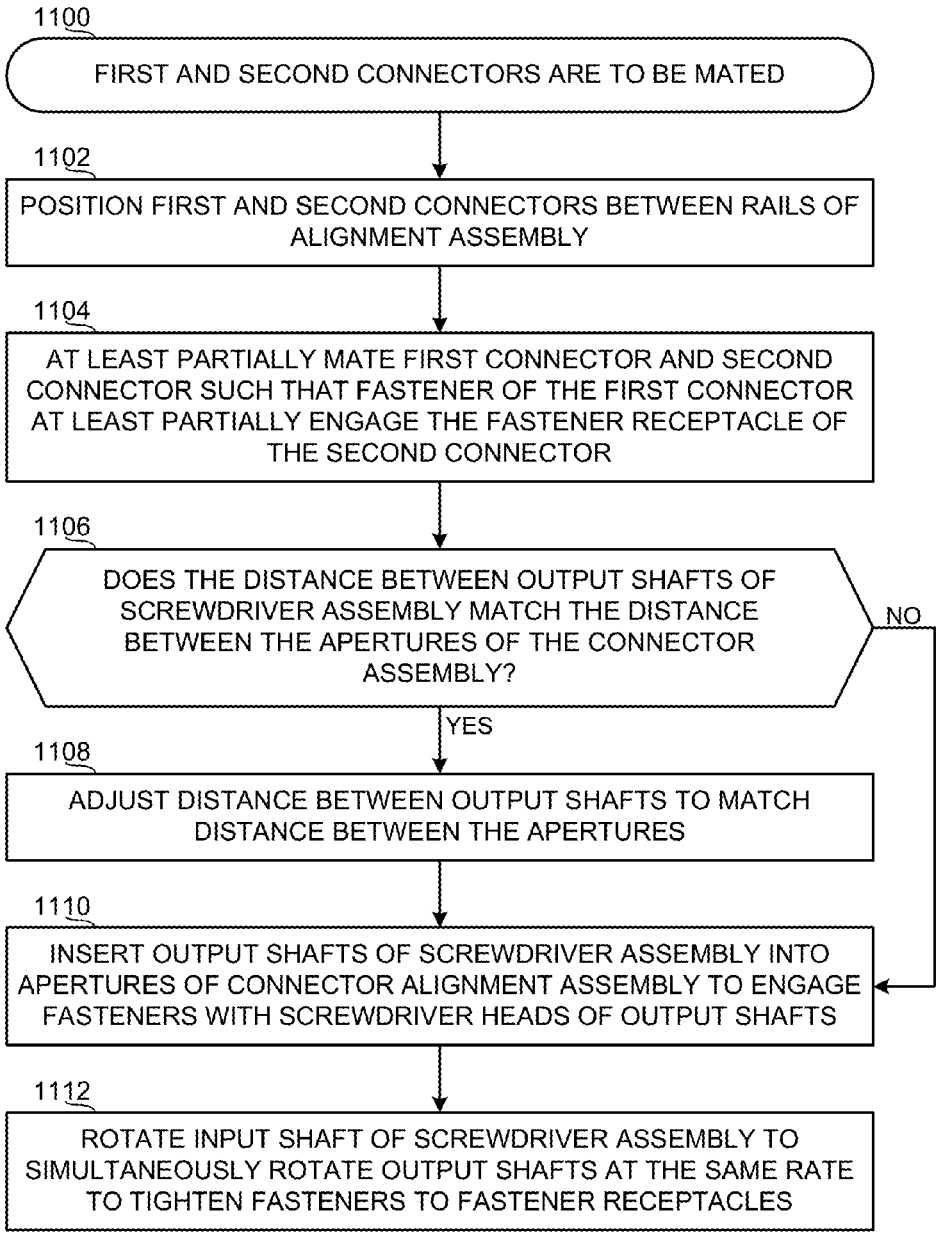
FIG. 11 is an example flow diagram representative of an example method of mating first and second connectors in accordance with the teachings of the disclosure.

FIG. 11 is an example flow diagram of an example method of mating first and second connectors in accordance with the teachings of this disclosure. Although the example flow diagram of FIG. 11 is described below in connection with the example female and male connectors 100 and 200 of FIGS. 1 and 2, the example flow diagram of FIG. 11 can be utilized with any suitable connectors or types of connectors.

The example of FIG. 11 begins with an indication that the female connector 100 is to be coupled or mated to the male connector 200 (block 1100). For example, while constructing, debugging, or installing a computing platform, the female connector 100 and the male connector 200 may need to be mated and decoupled one or more times. To bring the female connector 100 into alignment with the male connector 200, the female connector 100 is placed between the rails 802 and 804 of the example connector alignment assembly 800 of FIG. 8 and the male connector 200 is placed between the rails 802 and 804 (block 1102). As described above in connection with FIG. 8, the rails 802 and 804 ensure proper alignment of the mating surfaces 104 and 204 of the connectors 100 and 200. The female connector 100 and the male connector 200 are at least partially mated by pressing the connectors 100 and 200 together while still located between the rails 802 and 804 (block 1104). In the illustrated example, the connectors 100 and 200 are pressed together (e.g., by a user) such that the fasteners 106 and 108 at least partially engage the fastener receptacles 206 and 208. As a result, the connectors 100 and 200 are at least partially mated in proper alignment in the example connector alignment assembly 800.

In the illustrated example, the user utilizes the example screwdriver assembly 700 of FIG. 7A in conjunction with the example connector alignment assembly 800 to fully mate the female and male connectors 100 and 200. Alternatively, the user can utilize the screwdrivers 808 and 810 of FIG. 8 or the example screwdriver assembly 400 of FIG. 4. As described above, the example screwdriver assembly 700 of FIG. 7A can be adjusted to change the distance between the output shafts 714 and 716. In the example of FIG. 11, the distance between the output shafts 714 and 716 needs to substantially (e.g., within a threshold or tolerance) match a distance between the apertures 900 and 902 of the example connector alignment assembly 800. The user determines whether such an adjustment is needed for the example screwdriver assembly 700 (block 1106). If so, the example adjuster 722 is used to match the distance between the output shafts 808 and 810 to the apertures 900 and 902, which are aligned with the fasteners 106 and 108 (block 1108).

With the proper distance between the output shafts 808 and 810, the user inserts the output shafts 808 and 810 into the apertures 900 and 902 to engage the fasteners 106 and 108 (block 1110). The input shaft 704 is rotated via the handle 708 to simultaneously rotate the output shafts 808 and 810 at the same rate to tighten the fasteners 106 and 108 to the fastener receptacles 206 and 208 (block 1112). As a result, the female and male connectors 100 and 200 are mated together properly. The mated connectors 100 and 200 can be removed from the rails 802 and 804.

Figure 12:
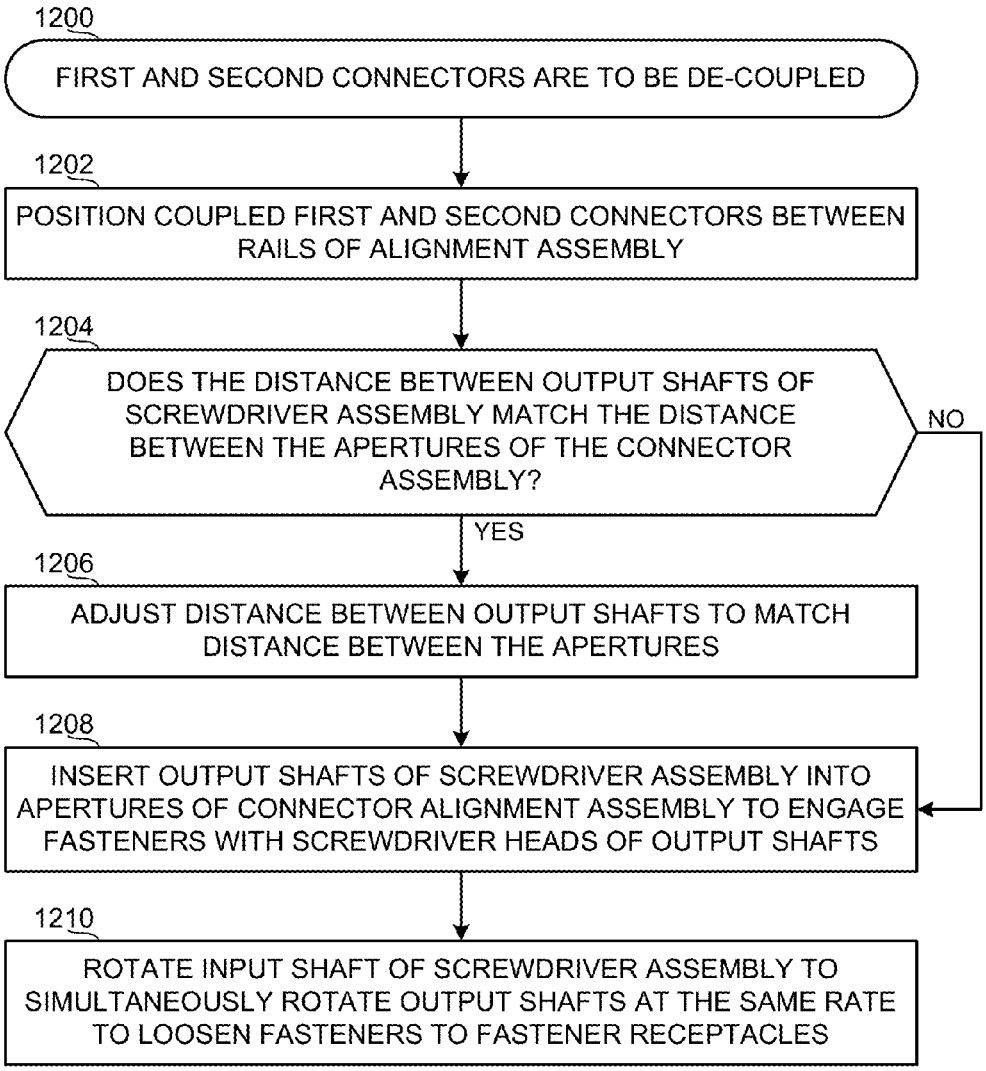
FIG. 12 is an example flow diagram representative of an example method of decoupling first and second connectors in accordance with the teachings of the disclosure.

FIG. 12 is an example flow diagram of an example method of decoupling first and second connectors in accordance with the teachings of this disclosure. Although the example flow diagram of FIG. 12 is described below in connection with the example female and male connectors 100 and 200 of FIGS. 1 and 2, the example flow diagram of FIG. 12 can be utilized with any suitable connectors or types of connectors.

The example of FIG. 12 begins with an indication that the female connector 100, which is currently coupled or mated to the male connector 200, needs to be detached or decoupled from the male connector 200 (block 1200). To ensure alignment between the connectors 100 and 200 during the decoupling process, the coupled connectors 100 and 200 are placed between the rails 802 and 804 of the example connector alignment assembly 800 of FIG. 8 (block 1202). As described above in connection with FIG. 8, the rails 802 and 804 ensure proper alignment of the mating surfaces 104 and 204 of the connectors 100 and 200. In the illustrated example, the user utilizes the example screwdriver assembly 700 of FIG. 7A in conjunction with the example connector alignment assembly 800 to fully mate the female and male connectors 100 and 200. Alternatively, the user can utilize the screwdrivers 808 and 810 of FIG. 8 or the example screwdriver assembly 400 of FIG. 4. In the example of FIG. 11, the distance between the output shafts 714 and 716 needs to substantially (e.g., within a threshold or tolerance) match a distance between the apertures 900 and 902 of the example connector alignment assembly 800. The user determines whether such an adjustment is needed for the example screwdriver assembly 700 (block 1204). If so, the example adjuster 722 is used to match the distance between the output shafts 808 and 810 to the apertures 900 and 902, which are aligned with the fasteners 106 and 108 (block 1206).

With the proper distance between the output shafts 808 and 810, the user inserts the output shafts 808 and 810 into the apertures 900 and 902 to engage the fasteners 106 and 108 (block 1208). The input shaft 704 is rotated via the handle 708 to simultaneously rotate the output shafts 808 and 810 at the same rate to loosen the fasteners 106 and 108 from the fastener receptacles 206 and 208 (block 1210). As a result, the female and male connectors 100 and 200 are decoupled while proper alignment is maintained. The separated connectors 100 and 200 can be removed from the rails 802 and 804.

Although certain example methods, apparatus and articles of manufacture have been described herein, the scope of coverage of this patent is not limited thereto. On the contrary, this patent covers all methods, apparatus and articles of manufacture fairly falling within the scope of the claims of this patent.

What is claimed is:

1. An apparatus, comprising:

a first leg including a first output shaft having a first screwdriver head;

a second leg including a second output shaft having a second screwdriver head;

an input shaft to rotate the first and second output shafts at the same time; and an adjuster to vary a distance between the first and second output shafts, wherein the first leg is to be coupled to the second leg via the input shaft, and wherein the input shaft forms a pivot point.

2. An apparatus as defined in claim 1, wherein the adjuster comprises a first portion threaded in a first direction and a second portion threaded in a second direction.

3. An apparatus as defined in claim 2, wherein the first portion is coupled to the first leg and the second portion is coupled to the second leg.

4. An apparatus as defined in claim 1, wherein rotation of the adjuster in a first direction pulls the first and second legs together, and rotation of the adjuster in a second direction pushes the first and second legs apart.

5. An apparatus as defined in claim 1, wherein the first and second legs are to rotate about the pivot point in response to rotation of the adjuster to change the distance between the first and second output shafts.

6. An apparatus as defined in claim 1, wherein the input shaft is to rotate the output shafts at the same rate.

7. An apparatus as defined in claim 1, further comprising a gear train having intermediate gears that transfer torque from the input shaft to outer gears to which the first and second output shafts are coupled.

8. An apparatus, comprising:

a first rail and a second rail parallel to the first rail, wherein the first and second rails are spaced apart to receive a first connector having fasteners spaced apart by a first distance; and a first aperture in the first rail and a second aperture in the second rail, the first and second apertures being spaced apart by the first distance, the first and second rails to align a first mating surface of the first connector with a second mating surface of a second connector when first and second connectors are engaged with the first and second rails.

9. An apparatus as defined in claim 8, further comprising a first screwdriver positioned in the first aperture and a second screwdriver positioned in the second aperture.

10. An apparatus as defined in claim 8, further comprising a panel coupled to the first and second rails and spanning from the first rail to the second rail.

11. An apparatus as defined in claim 10, wherein the first rail is to restrict movement of the first connector in a first direction when the first connector is positioned between the first and second rails, wherein the second rail is to restrict movement of the first connector in a second direction when the first connector is positioned between the first and second rails, wherein the panel restricts movement of the first connector in a third direction when the first connector is positioned between the first and second rails, wherein the first, second and third directions are different.

12. An apparatus as defined in claim 8, wherein the alignment of the first and second mating surfaces comprises the first mating surface being on a first plane perpendicular to a longitudinal axis of the first and second rails and the second mating surface being on a second plane perpendicular to the longitudinal axis of the first and second rails, wherein the first and second planes are parallel.

13. A method, comprising:

positioning a first connector between a first rail and a second rail of an alignment assembly;

positioning a second connector between the first and second rails; and inserting first and second output shafts of a synchronized screwdriver into apertures of the alignment assembly, wherein the apertures are aligned with fasteners of the first connector.

14. A method as defined in claim 13, further comprising partially mating the first connector with the second connector while the first and second connectors are positioned between the first and second rails.

15. A method as defined in claim 14, further comprising rotating an input shaft of the synchronized screwdriver assembly to simultaneously rotate the fasteners of the first connector.

16. A method as defined in claim 13, further comprising adjusting a distance between the first and second output shafts of the synchronized screwdriver to match a distance between the apertures of the alignment assembly.

17. An apparatus, comprising:

a first leg including a first output shaft having a first screwdriver head;

a second leg including a second output shaft having a second screwdriver head;

an input shaft to rotate the first and second output shafts at the same time; and an adjuster to vary a distance between the first and second output shafts, the adjuster comprising a first portion threaded in a first direction and a second portion threaded in a second direction.

18. An apparatus, comprising:

a first leg including a first output shaft having a first screwdriver head;

a second leg including a second output shaft having a second screwdriver head;

an input shaft to rotate the first and second output shafts at the same time; and an adjuster to vary a distance between the first and second output shafts, wherein rotation of the adjuster in a first direction pulls the first and second legs together, and rotation of the adjuster in a second direction pushes the first and second legs apart.

19. An apparatus, comprising:

a first rail and a second rail parallel to the first rail, wherein the first and second rails are spaced apart to receive a first connector having fasteners spaced apart by a first distance;

a first aperture in the first rail and a second aperture in the second rail, the first and second apertures being spaced apart by the first distance; and a first screwdriver positioned in the first aperture and a second screwdriver positioned in the second aperture.

20. An apparatus, comprising:

a first rail and a second rail parallel to the first rail, wherein the first and second rails are spaced apart to receive a first connector having fasteners spaced apart by a first distance; and a first aperture in the first rail and a second aperture in the second rail, the first and second apertures being spaced apart by the first distance, wherein a first mating surface of the first connector is aligned with a second mating surface of a second connector by the first mating surface being on a first plane perpendicular to a longitudinal axis of the first and second rails and the second mating surface being on a second plane perpendicular to the longitudinal axis of the first and second rails, wherein the first and second planes are parallel.

* * * * *